US005883587A

United States Patent [19]

Ikemoto

[11] Patent Number: 5,883,587

[45] Date of Patent: Mar. 16, 1999

[54] VEHICLE POSITION RECOGNITION APPARATUS

[75] Inventor: Katsuya Ikemoto, Tokyo, Japan

[73] Assignee: Mitsubishi Denki Kabushiki Kaisha, Tokyo, Japan

[21] Appl. No.: 885,799

[22] Filed: Jun. 30, 1997

[30] Foreign Application Priority Data

Jan. 22, 1997 [JP] Japan ..... 9-009522

[51] Int. Cl.[6] ..... G08G 1/123

[52] U.S. Cl. ..... 340/988; 340/933; 340/941; 340/935; 340/928; 180/163; 180/169; 701/23

[58] Field of Search ..... 340/988, 933, 340/941, 935, 901, 905, 928; 701/23; 318/587; 180/169, 168

[56] References Cited

U.S. PATENT DOCUMENTS

| | | | |
|---|---|---|---|
| 4,714,124 | 12/1987 | Laib | 180/168 |
| 4,847,774 | 7/1989 | Tomikawa et al. | 701/207 |
| 4,908,557 | 3/1990 | Sudare et al. | 318/580 |
| 5,189,612 | 2/1993 | Lemercier et al. | 701/23 |
| 5,191,528 | 3/1993 | Yardley et al. | 701/23 |
| 5,708,427 | 1/1998 | Bush | 340/941 |

FOREIGN PATENT DOCUMENTS 8-16236 1/1996 Japan .

*Primary Examiner*—Benjamin C. Lee
*Attorney, Agent, or Firm*—Sughrue, Mion, Zinn, Macpeak & Seas, PLLC

[57] ABSTRACT

A vehicle position recognition apparatus comprising one or a plurality of magnetic field formation means 1-1 installed at predetermined positions on a road for forming a predetermined magnetic field, magnetic field strength detection means 1-4 for detecting the magnetic field formed by the magnetic field formation means 1-1, vehicle position computation suitability judgment means 1-5 for judging whether the magnetic field strength, obtained by the magnetic field detection means 1-4, is suitable or not for computing a position of the vehicle, and vehicle position computation means 1-6 for receiving a result of the judgment of the vehicle position computation suitability judgment means 1-5 and for detecting the position of the vehicle by the magnetic field strength detected by the magnetic field strength detection means 1-4.

5 Claims, 15 Drawing Sheets

VEHICLE POSITION RECOGNITION APPARATUS

BACKGROUND OF THE INVENTION

1. Field of the Invention

The present invention relates to a vehicle position recognition apparatus that senses a magnetic field formed on a road on which the vehicle is traveling by vehicle-mounted magnetic field sensors to recognize the self-position (e.g., position of itself) of the vehicle, and more particularly to an apparatus for judging whether the strength of a detected magnetic field is suitable for the position recognition of a vehicle.

2. Description of the Related Art

FIG. 14 is a diagram showing the installed state of a magnetic field induction cable that is employed in a vehicle position detector disclosed, for example, in Japanese Patent Laid-Open No. 8-16236. The magnetic field induction cable 14-1 is offset alternately by D/2 at intervals of a predetermined distance L with respect to a target induction line (indicated by a broken line) provided on a road 14-0, and the induction cable 14-1 is installed continuously in a square wave path.

The aforementioned D represents an arbitrary distance which satisfies D<W (where W is the distance between left and right magnetic field sensors mounted in a vehicle). The resultant magnetic field (e.g., first resultant magnetic field) Z of the detected magnetic field strengths VR and VL of the right and left magnetic field sensors is computed by the following Eq. (1).

$$Z=(VL-VR)/(VL+VR) \tag{1}$$

Furthermore, a second resultant magnetic field Zc is computed by the sum of the magnetic field Za at the a-point of the magnetic field induction cable 14-1 and the magnetic field Zb at the b-point.

$$Zc=Za+Zb \tag{2}$$

The second resultant magnetic field Zc and the lateral displacement quantity X (e.g., quantity that a vehicle is displaced laterally from a target induction line) correspond to 1:1 at an interval of X[−(W+D)/2, (W+D)/2], and the lateral displacement quantity X is determined.

Now, the operation of a conventional apparatus will be described in reference to FIGS. 15 and 16.

FIG. 15 is a block diagram of the conventional apparatus. The vehicle is provided with a right magnetic field sensor 15-1 and a left magnetic field sensor 15-3, which are laterally spaced by distance W. The magnetic field strengths VR and VL detected by the magnetic field sensors 15-1 and 15-2 are inputted to a CPU 15-2 and the resultant magnetic field Zc of the strengths VR and VL is computed.

Also, the relation between the second resultant magnetic field Zc and the lateral displacement quantity X is previously computed and the relation is stored on memory 15-4 as a map.

The CPU 15-2 accesses the memory 15-4 to read out the lateral displacement quantity X corresponding to the computed second resultant magnetic field Zc. The lateral displacement quantity X is output as a control signal to a steering actuator (not shown) to perform a steering operation so that the lateral displacement X is corrected, and a vehicle is automatically controlled.

Next, the computation processes by the CPU 15-2 will be described with a flowchart of FIG. 16. The CPU 15-2 reads a value C of a wheel pulse counter (not shown) (step 16-1) and computes a traveled distance by multiplying the counter value C by a traveled distance d per one pulse.

Then, it is judged whether the traveled distance exceeds L (in FIG. 14 the length of the left or right offset portion) (step 16-2). When it has exceeded L, the counter value is reset (step 16-3) and the detected magnetic field strengths VR and VL are read from the right and left magnetic field sensors 14*a* and 14*b* (step 16-4 and step 16-5).

The CPU 15-2 computes the first resultant magnetic field Z from Z=(VL−VR)/(VL+VR), based on the detected magnetic field strengths VR and VL (step 16-6). The first resultant magnetic field Z is either the resultant magnetic field Za of the right offset portion or the resultant magnetic field Zb of the left offset portion.

After computation of the first resultant magnetic field Z, the CPU 15-2 checks the value of flag f1 (step 16-7). If f1=0 does not exist, then it is judged that a vehicle is positioned at the right offset portion (a-point in FIG. 14). Then, the CPU 15-2 makes the first resultant magnetic field Z equal to Za (e.g., Za=Z) (step 16-8) and sets flag f1 to 0 (step 16-9).

When, on the other hand, flag f1 is 0, it is judged that a vehicle is positioned at the left offset portion (b-point in FIG. 14). Then, the CPU 15-2 makes the first resultant magnetic field Z equal to Zb (e.g., Zb=Z) (step 16-10) and sets flag f1 to 1 (step 16-11). Thus, each time a vehicle travels by distance L, the value of flag f1 is alternately set to 0 and 1 and the resultant magnetic fields Za and Zb are computed.

Note that during an initial travel of a vehicle, only either the resultant magnetic field Za or Zb is computed even when the vehicle travels by distance L. In this case, at the time step 16-9 has ended, the computation operation in the CPU 15-2 will return to step 16-1 again. Then, after computation of the resultant magnetic fields Za and Zb, the CPU 15-2 computes the second resultant magnetic field Zc=Za+Zb from the computed magnetic fields Za and Zb (step 16-12). Next, the CPU 15-2 accesses the memory 15-4 to read out the lateral displacement quantity X corresponding to the second resultant magnetic field Zc from the map stored on the memory 15-4 (step 16-13). With this, the lateral displacement quantity X of a vehicle can be detected within a detection range of W+D.

In addition, the detection range has been enlarged from conventional W to W+D, so it becomes possible to control a vehicle at a speed faster than a conventional speed even on a road where in the conventional apparatus the speed of the vehicle had to be reduced so that the vehicle does not travel out of the detection range.

The conventional apparatus, as previously described, detects the magnetic field formed on a road by the vehicle-mounted magnetic field sensors and, based on the result of the detection, recognizes the self-position of the vehicle. However, when a vehicle is displaced laterally or when substance or a magnetic body is disturbing the magnetic field formed on a road, the magnetic field is disturbed and the relation between the resultant magnetic field and the lateral displacement quantity, previously stored on the memory, is no longer established. Consequently, there arises the problem that a mistaken lateral displacement quantity is computed and causes a mistake in steering control.

BRIEF SUMMARY OF THE INVENTION

Object of the Invention

The objective of the present invention is to solve the aforementioned problem and to provide a vehicle position recognition apparatus which is capable of accurately obtaining the position of a vehicle while excluding the influences of the lateral displacement of the vehicle, the speed of the vehicle, and the substance and magnetic body disturbing a magnetic field formed on a road.

SUMMARY OF THE INVENTION

To achieve the above objective, the vehicle position recognition apparatus according to the present invention comprises at least one magnetic field formation means provided at predetermined positions on the road for forming a magnetic field, at least one magnetic field strength detection means for detecting the strength of the magnetic field formed by the magnetic field formation means, and vehicle position computation suitability judgment means for judging whether or not the magnetic field strength detected by the magnetic field strength detection means is suitable for position computation of the vehicle. The apparatus further comprises vehicle position computation means for detecting the position of the vehicle from the magnetic field strength detected by the magnetic field strength detection means, based on a result of the judgment performed by the vehicle position computation suitability judgment means.

The magnetic field strength detection means according to the present invention comprises traveled-distance computation means for computing a distance traveled by the vehicle, magnetic field sampling means for sampling magnetic field state at intervals of predetermined distance, and magnetic field recording means for recording a space distribution of the magnetic field strength obtained by the magnetic field sampling means.

The vehicle position computation suitability judgment means according to the present invention comprises vertical magnetic field strength detection means for detecting a vertical component of the magnetic field strength obtained by the magnetic field strength detection means, and vertical magnetic field strength comparison means for comparing a space distribution of the vertical magnetic field strength obtained by the vertical magnetic field strength detection means with a space distribution of the vertical component of the magnetic field strength formed by the magnetic field formation means. The vehicle position computation suitability judgment means further comprises maximum vertical magnetic field position detection means for detecting a position of the maximum vertical magnetic field on the space distribution of the vertical magnetic field strength detected by the vertical magnetic field strength detection means, and magnetic field strength change quantity detection means for comparing a vertical magnetic field strength at the maximum vertical magnetic field position detected by the maximum vertical magnetic field position detection means with a magnetic field strength at a position away from the maximum vertical magnetic field position by a predetermined distance and for detecting a change quantity in the magnetic field caused by the distance. The vehicle position computation suitability judgment means further comprises maximum vertical magnetic field strength transition comparison means for comparing the magnetic field strength at the maximum vertical magnetic field position detected by the maximum vertical magnetic field position detection means with a past maximum vertical magnetic field strength detected by the maximum vertical magnetic field position detection means, and computation suitability judgment means for judging whether or not the detected magnetic field strength is suitable for the position computation of the vehicle, based on results of the magnetic field strength change quantity detection means and the maximum vertical magnetic field strength transition comparison means.

The vertical magnetic field strength comparison means according to the present invention does not compare the maximum vertical magnetic field strength in a non-judgment region which has a predetermined width from the center of the maximum vertical magnetic field position obtained by the maximum vertical magnetic field position detection means.

The magnetic field strength detection means according to the present invention comprises non-magnetic field position judgment means for judging a position which is not influenced by the magnetic field formed by the magnetic field formation means, non-magnetic field position recording means for recording a magnetic field strength value sampled at the non-magnetic field position, and sampled-magnetic field value correction means for correcting a magnetic field value sampled at a magnetic field position by a sampled magnetic field strength value recorded by the non-magnetic field position recording means.

The vehicle position computation suitability judgment means according to the present invention judges whether or not an absolute value of a difference between the maximum and minimum strengths of magnetic field strengths, obtained by a plurality of magnetic field strength detection means, is greater than a predetermined threshold value.

BRIEF DESCRIPTION OF THE DRAWINGS

The present invention will be described in further detail with reference to the accompanying drawings, in which.

DETAILED DESCRIPTION OF THE PREFERRED EMBODIMENTS

First Embodiment

Figure 1:
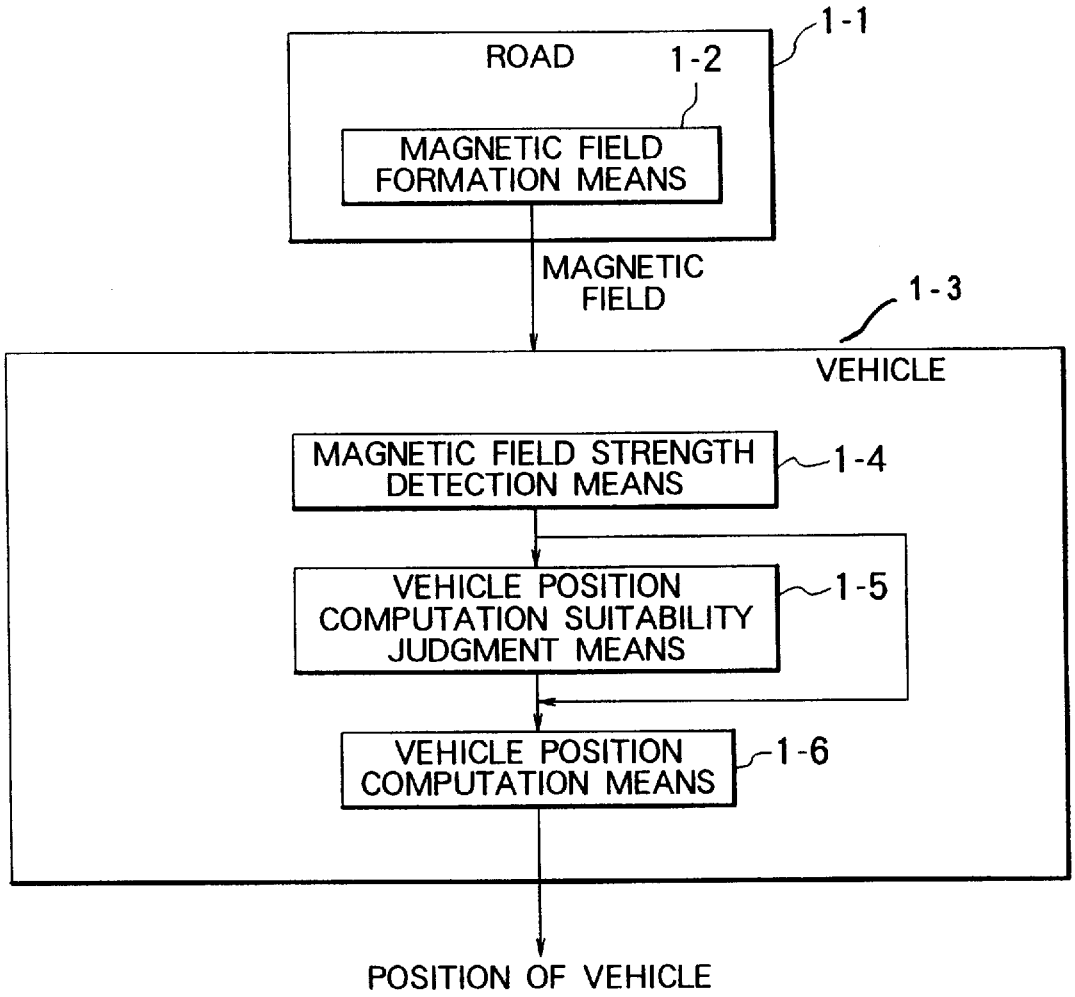
FIG. 1 is a block diagram showing a vehicle position recognition apparatus constructed in accordance with a first embodiment of the present invention.

FIG. 1 is a block diagram showing a vehicle position recognition apparatus constructed in accordance with a first embodiment of the present invention. Vehicle 1-3 travels through a magnetic field formed by magnetic field formation means 1-2 installed on a road 1-1 such as a magnetic nail embedded in a road. The vehicle 1-3 is equipped with magnetic field strength detection means 1-4 for detecting a strength of a formed magnetic field, vehicle position computation suitability judgment means 1-5 for judging whether the detected magnetic field strength is suitable or not for computing a position of the vehicle, and vehicle position computation means 1-6 for computing a lateral displacement quantity of the vehicle from the detected magnetic field strength when it is judged by the vehicle position computation suitability judgment means 1-5 that the detected magnetic field strength is suitable for computing a position of the vehicle.

The processes by the aforementioned means are performed by a CPU (not shown) mounted in a vehicle. Also, the means 1-4 through 1-6 are equipped with storage sections for temporarily storing detection result, judgment result, and computation result, respectively. The objective of the present invention is to verify whether a magnetic field strength suitable for a computation of lateral displacement quantity X has been detected or not.

Figure 2:
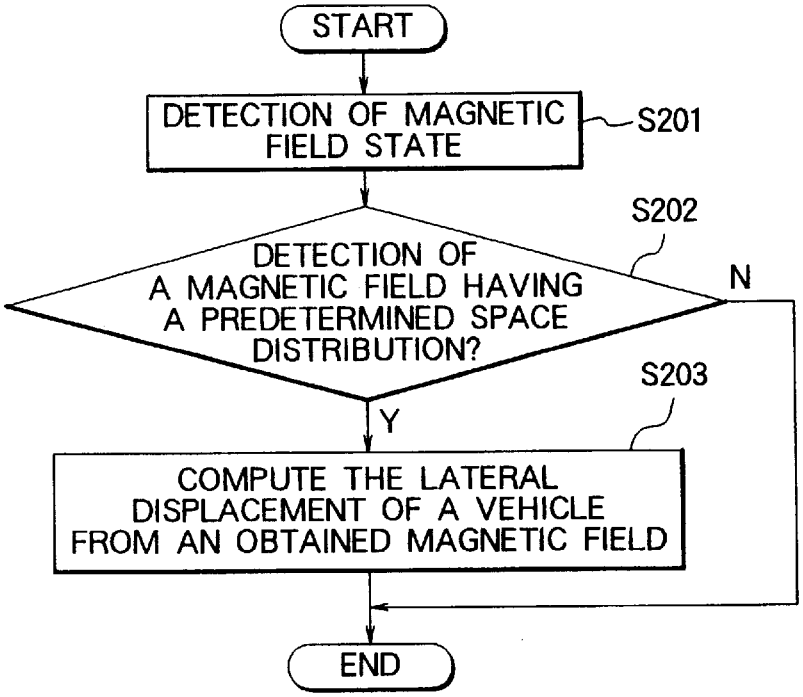
FIG. 2 is a flowchart showing the process that is performed by the vehicle position recognition apparatus of the first embodiment.

Next, the operation of the vehicle position recognition apparatus in the first embodiment will be described along a flowchart shown in FIG. 2. This flowchart shows the processes that are performed by the CPU. First, the magnetic field strength detection means 1-4 detects a magnetic field strength distribution while detecting a magnetic field strength (step S201). It is verified whether or not the magnetic field strength distribution detected in step S201 has a predetermined space distribution formed by the magnetic field formation means 1-2 (step S202). If the detected magnetic field state is a magnetic field state having a predetermined space distribution formed by the magnetic field formation means 1-2, then a lateral displacement of the vehicle is computed from the detected magnetic field strength (step S203). However, if the detected magnetic field state is not the magnetic field state formed by the magnetic field formation means 1-2, then it is judged that it is not suitable for the computation of the lateral displacement, and step S201 is restarted at the next computation cycle.

Figure 3:
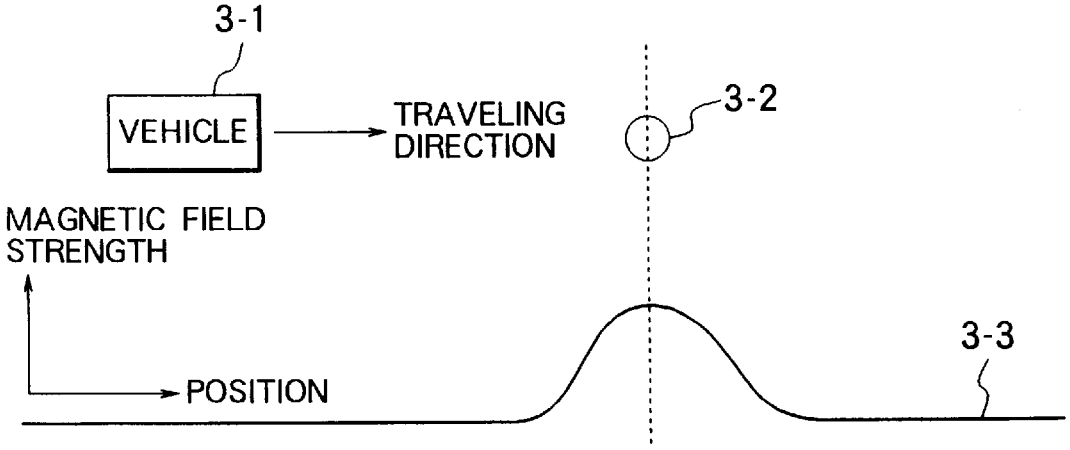
FIG. 3 is a diagram used to explain the concepts of the vehicle position recognition apparatus of the first embodiment.

FIG. 3 shows the state of a magnetic field strength space distribution that is formed on a road and is a plan view of the vehicle 3-1 and the magnetic field formation means 3-2. The vehicle 3-1 detects a magnetic field strength while traveling through the magnetic field formed by the magnetic field formation means 3-2. At this time, a magnetic field having a strength such as that shown by magnetic field strength space distribution 3-3 is formed on a road.

The magnetic field strength space distribution 3-3 depends upon the distance from the magnetic field formation means 3-2. That is, the magnetic field strength is reduced, as it goes away from the magnetic field formation means 3-2. When the vehicle position computation suitability judgment means 1-5 judges that a magnetic field is suitable for the computation of the lateral displacement of a vehicle, the vehicle position computation means 1-6 computes the lateral displacement quantity of a vehicle, based on the magnetic field strength detected by the magnetic field strength detection means 1-4.

Second Embodiment

Figure 4:
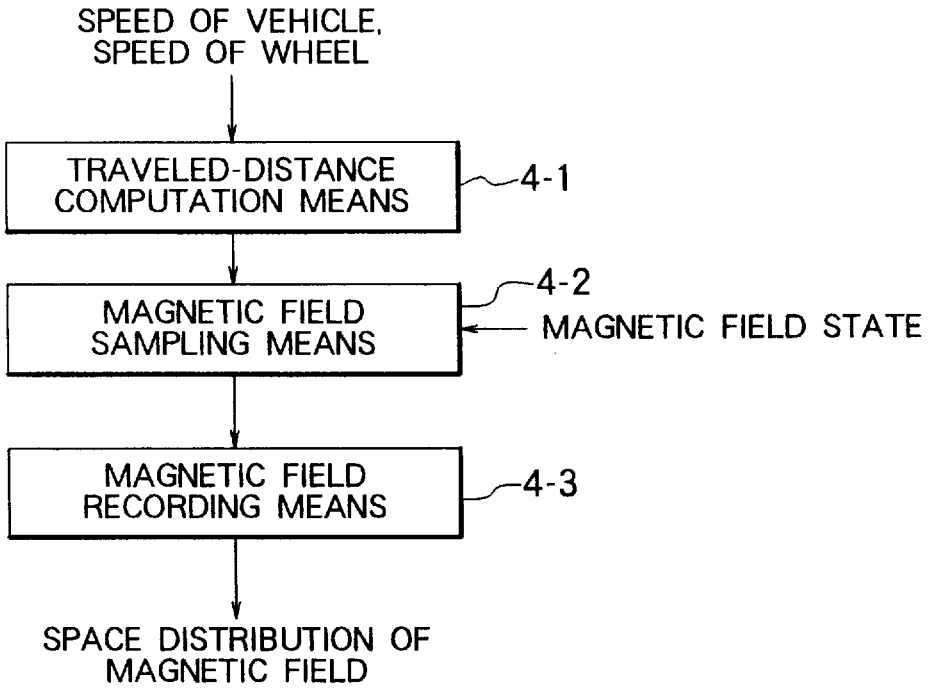
FIG. 4 is a block diagram showing a vehicle position recognition apparatus in accordance with a second embodiment of the present invention.

This embodiment describes the operation of the magnetic field strength detection means that is performed when a magnetic field strength space distribution suitable for the position computation of a vehicle is accurately obtained. FIG. 4 is a block diagram showing magnetic field strength detection means 1-4 in accordance with the second embodiment.

The magnetic field strength detection means 1-4 is constituted by traveled-distance computation means 4-1 for computing a traveled distance, magnetic field sampling means 4-2 for sampling a magnetic field state at intervals of a predetermined traveled distance, and magnetic field recording means 4-3 for recording a magnetic field strength space distribution obtained by the magnetic field sampling means 4-2.

Figure 5:
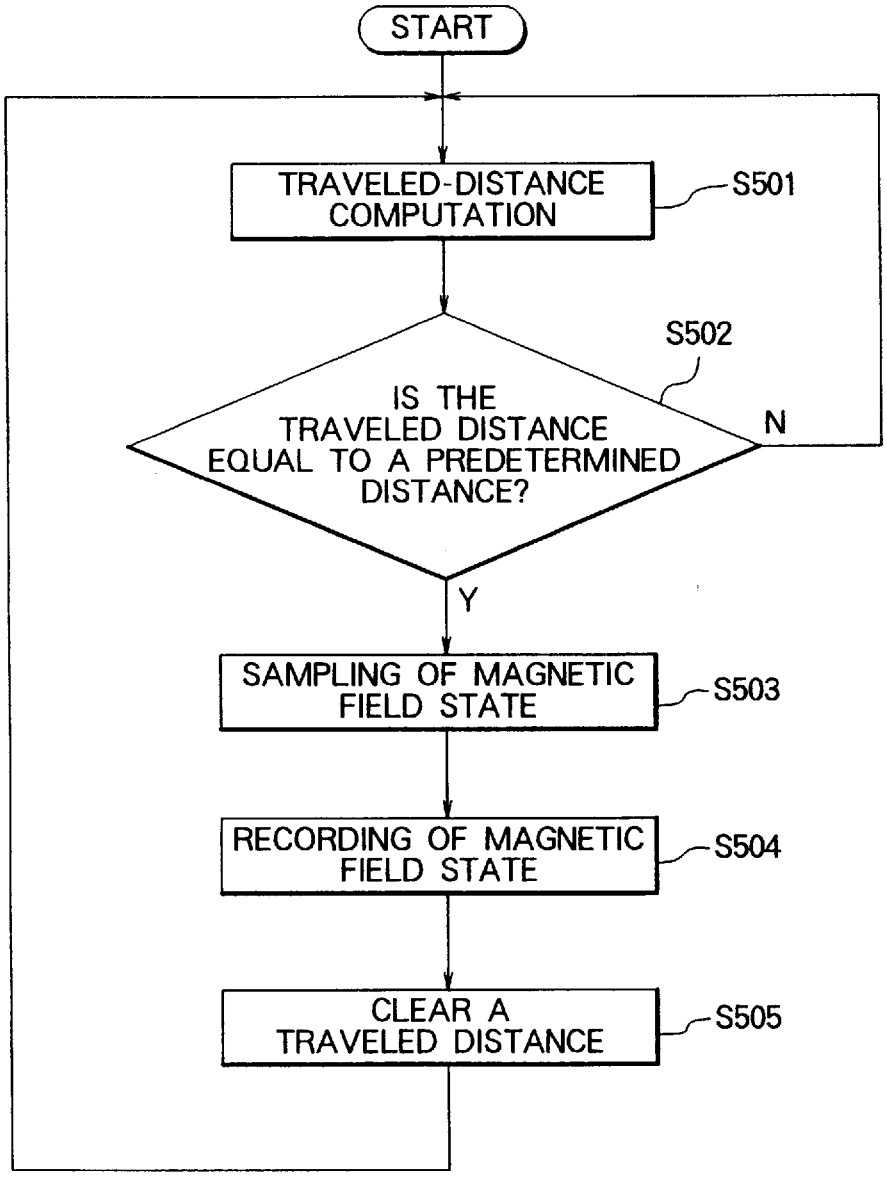
FIG. 5 is a flowchart showing the process that is performed by the vehicle position recognition apparatus of the second embodiment.

Next, the operation of the second embodiment will be described according to a flowchart of FIG. 5. First, the traveled-distance computation means 4-1 integrates the speed of a vehicle or wheel and computes a traveled distance (step S501). Then, it is judged whether or not the obtained traveled distance has been equal to a predetermined traveled distance (step S502). When it is not equal to the predetermined distance, step S502 returns to step S501 and the computation of a traveled distance is performed again.

As the result of the computation, when the computed distance is equal to the predetermined distance, a magnetic field state is sampled, as the vehicle travels (step S503). Then, the sampled magnetic field state is recorded (step S504), and the traveled distance obtained in step S501 is cleared and set to 0 (step S505). The operation of steps S501 through S505 is repeated while traveling, and the magnetic field state is recorded at intervals of a predetermined distance.

Figure 6:
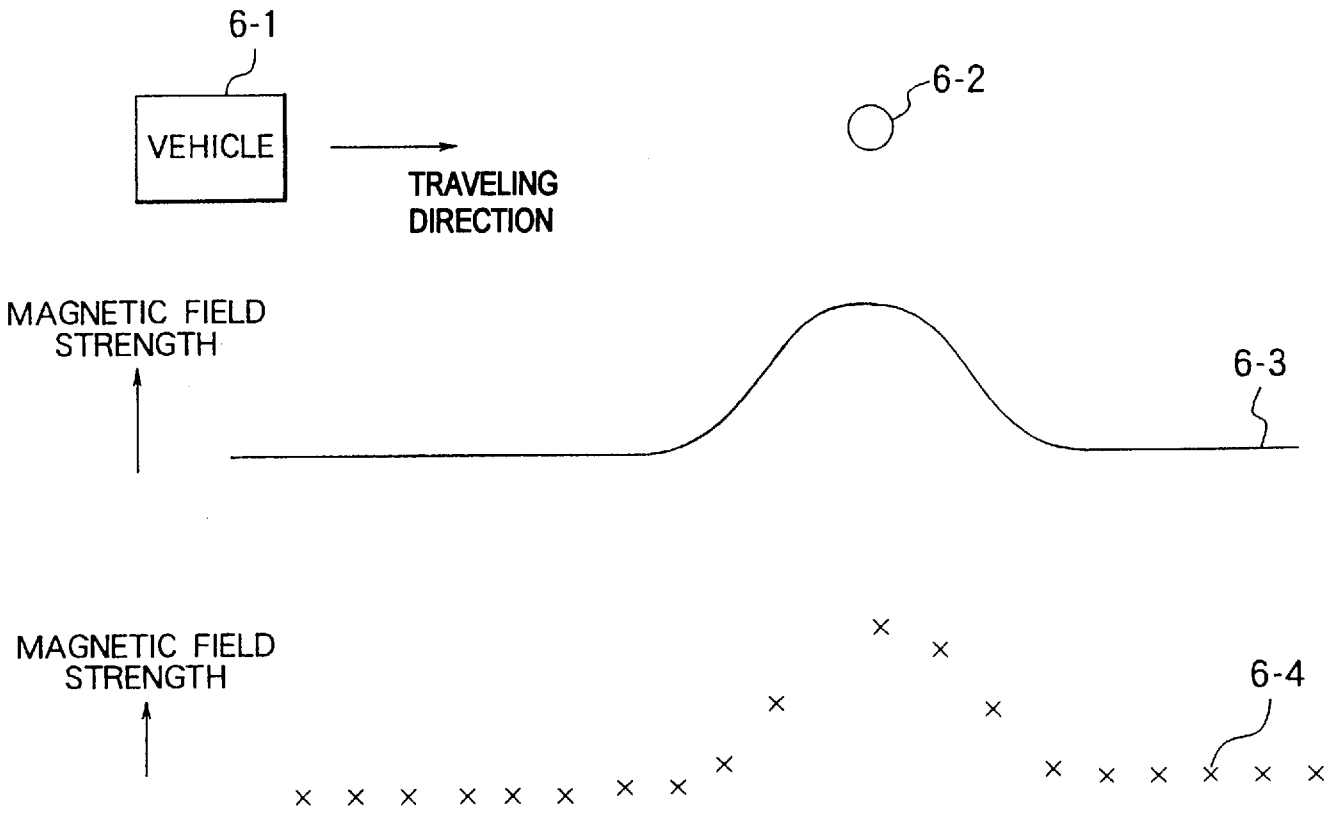
FIG. 6 is a diagram used to explain the concepts of the vehicle position recognition apparatus of the second embodiment.

FIG. 6 shows how a magnetic field strength is recorded while sampling a magnetic field state. Vehicle 6-1 is traveling through a magnetic field 6-3 formed by magnetic field formation means 6-2. When the vehicle 6-1 is traveling, the magnetic field sampling means 4-2 samples a magnetic field state at intervals of a predetermined distance. As a consequence, a magnetic field space distribution 6-4 indicated by "x" is obtainable. By recognizing this magnetic field space distribution 6-4, there is accurately obtainable a magnetic field strength space distribution which is suitable for the lateral displacement computation of a vehicle.

Third Embodiment

While the magnetic field strength detection means in the second embodiment has integrated the speed of a vehicle or wheel and computed a traveled distance, the time between current time and the next sampling may be computed from the speed of a vehicle or wheel immediately after sampling by the following equation, and sampling may be performed immediately after the computed time.

$$T_{int}=S_{dist}/V_S$$

where $T_{int}$ represents the time interval until magnetic field sampling, $S_{dist}$ the predetermined sampling distance interval, and $V_S$ the speed of a vehicle or wheel.

Fourth Embodiment

Figure 7:
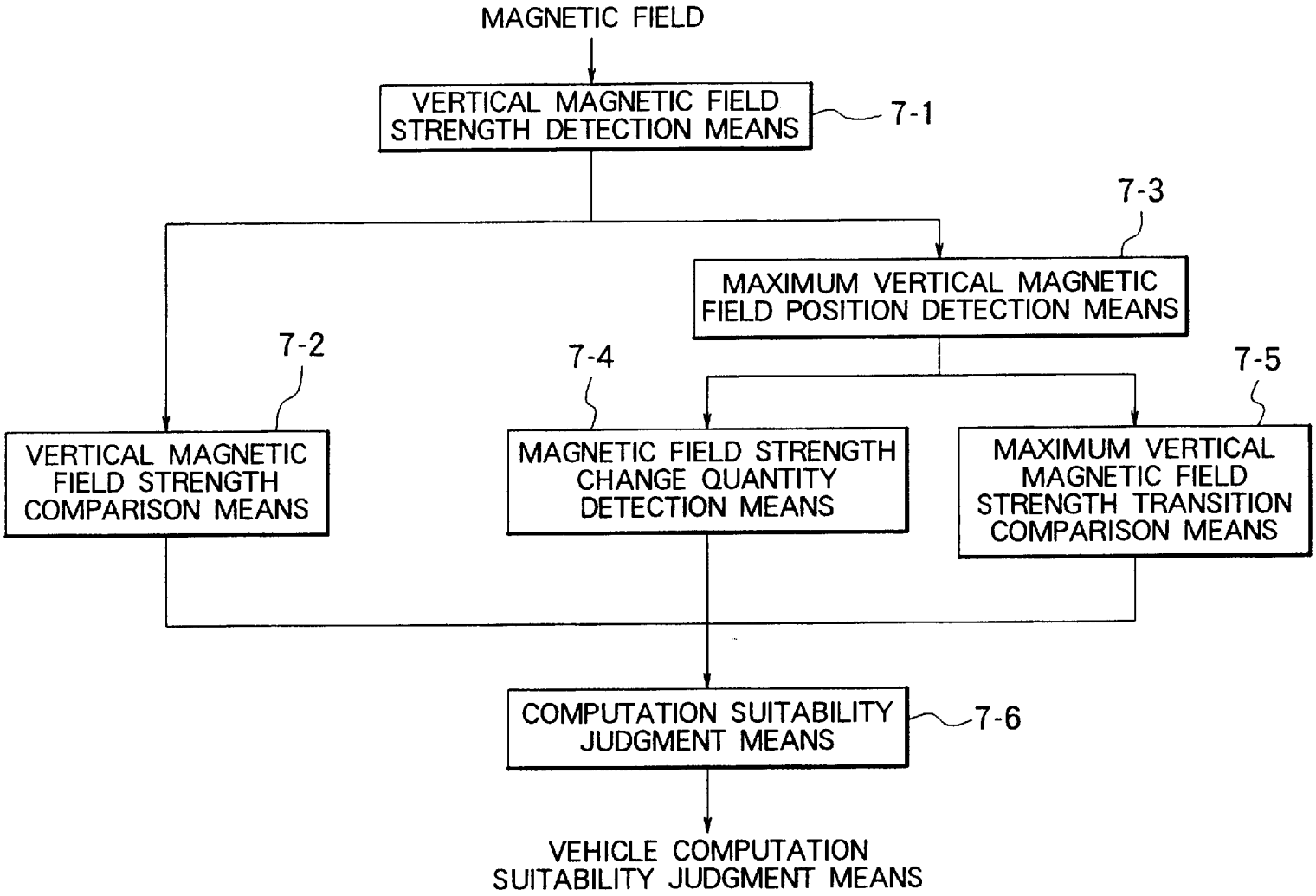
FIG. 7 is a block diagram showing a vehicle position recognition apparatus in accordance with a fourth embodiment of the present invention.

FIG. 7 is a block diagram showing vehicle position computation suitability judgment means 1-5 in accordance with the fourth embodiment of the present invention. The vehicle position computation suitability judgment means 1-5 is equipped with vertical magnetic field strength detection means 7-1 for detecting only the vertical component of a magnetic field strength detected by the magnetic field strength detection means 1-4 (not shown), vertical magnetic field strength comparison means 7-2 for comparing the degree of match between the vertical component of the magnetic field strength detected by the vertical magnetic field strength detection means 7-1 and the vertical component of a predetermined magnetic field strength previously formed and stored by magnetic field formation means, and maximum vertical position detection means 7-3 for detecting a position at which the vertical component of the magnetic field strength detected by the vertical magnetic field strength detection means 7-1 becomes maximum. The vehicle position computation suitability judgment means 1-5 is further equipped with magnetic field strength change quantity detection means 7-4 for comparing the vertical magnetic field strength of the maximum vertical magnetic field position detected by the maximum vertical position detection means 7-3 with a vertical magnetic field strength at a point away from the maximum vertical magnetic field position by a predetermined distance and for detecting whether there is a sufficient change quantity. The vehicle position computation suitability judgment means 1-5 is further equipped with maximum vertical magnetic field strength transition comparison means 7-5 for comparing the vertical magnetic field strength of the maximum vertical magnetic field position detected by the maximum vertical position detection means 7-3 with the maximum vertical magnetic field strength of the vertical magnetic field strength of magnetic field formation means 8-2 previously detected and stored by the maximum vertical position detection means 7-3 and for judging the time change quantity of a magnetic field strength. The vehicle position computation suitability judgment means 1-5 is further equipped with computation suitability judgment means 7-6 for receiving the results of the vertical magnetic field strength comparison means 7-2, the magnetic field strength change quantity detection means 7-4, and the maximum vertical magnetic field strength transition comparison means 7-5, also for judging whether or not a detected magnetic field strength is similar to the strength of a magnetic field formed by magnetic field formation means, and furthermore for determining whether or not the detected magnetic field strength is suitable for the lateral displacement computation of a vehicle.

Figure 8:
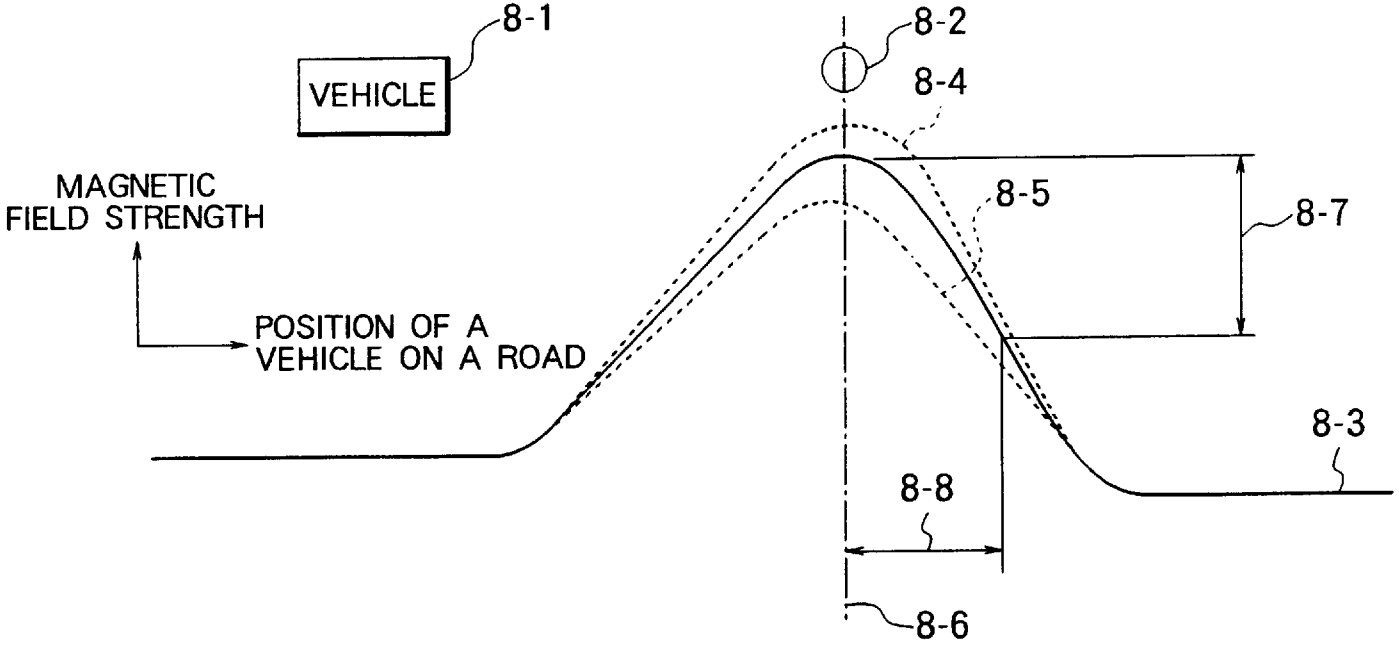
FIG. 8 is a diagram used to explain the concepts of the vehicle position recognition apparatus of the fourth embodiment.

FIG. 8 shows the vertical component space distribution of each magnetic field for explaining the fourth embodiment. In the figure, vehicle 8-1 is traveling through a magnetic field formed by the magnetic formation means 8-2. At this time, the vertical magnetic field strength detection means 7-1 samples a magnetic field strength at intervals of a predetermined distance traveled by the vehicle 8-1 and obtains the vertical component space distribution 8-3 of the magnetic field. The vertical magnetic field strength comparison means 7-2 compares the degree of match between the vertical component space distribution 8-3 of the magnetic field and a predetermined vertical component distribution 8-4 of the magnetic field formed and stored by the magnetic field formation means 8-2.

The maximum vertical magnetic field position detection means 7-3 detects maximum vertical magnetic field position 8-6 from the vertical component space distribution 8-3 of the sampled magnetic field. Thereafter, the magnetic field strength change quantity detection means 7-4 compares the maximum vertical magnetic field with the vertical component of a magnetic field at a point away from the maximum vertical magnetic field position 8-6 by a predetermined distance 8-8 and detects whether there is a sufficient change quantity in the vertical magnetic field. That is, this is for judging whether a vehicle has passed over the magnetic formation means 8-2, from a change quantity in the vertical magnetic field along the vertical magnetic field component space distribution 8-4.

The maximum vertical magnetic field strength transition comparison means 7-5 compares the past vertical magnetic field component 8-5 stored at the maximum vertical magnetic field position 8-6 with the maximum strength of the latest vertical magnetic field component 8-3. That is, this is for judging whether a vehicle has passed each magnetic field formation means 8-1 having the same vertical magnetic field component space distribution 8-4.

The computation suitability judgment means 7-6 determines, from the results of the magnetic field strength change quantity detection means 7-4 and the maximum vertical magnetic field strength transition comparison means 7-5, whether or not a detected magnetic field strength is suitable for the lateral displacement computation of a vehicle.

Figure 9:
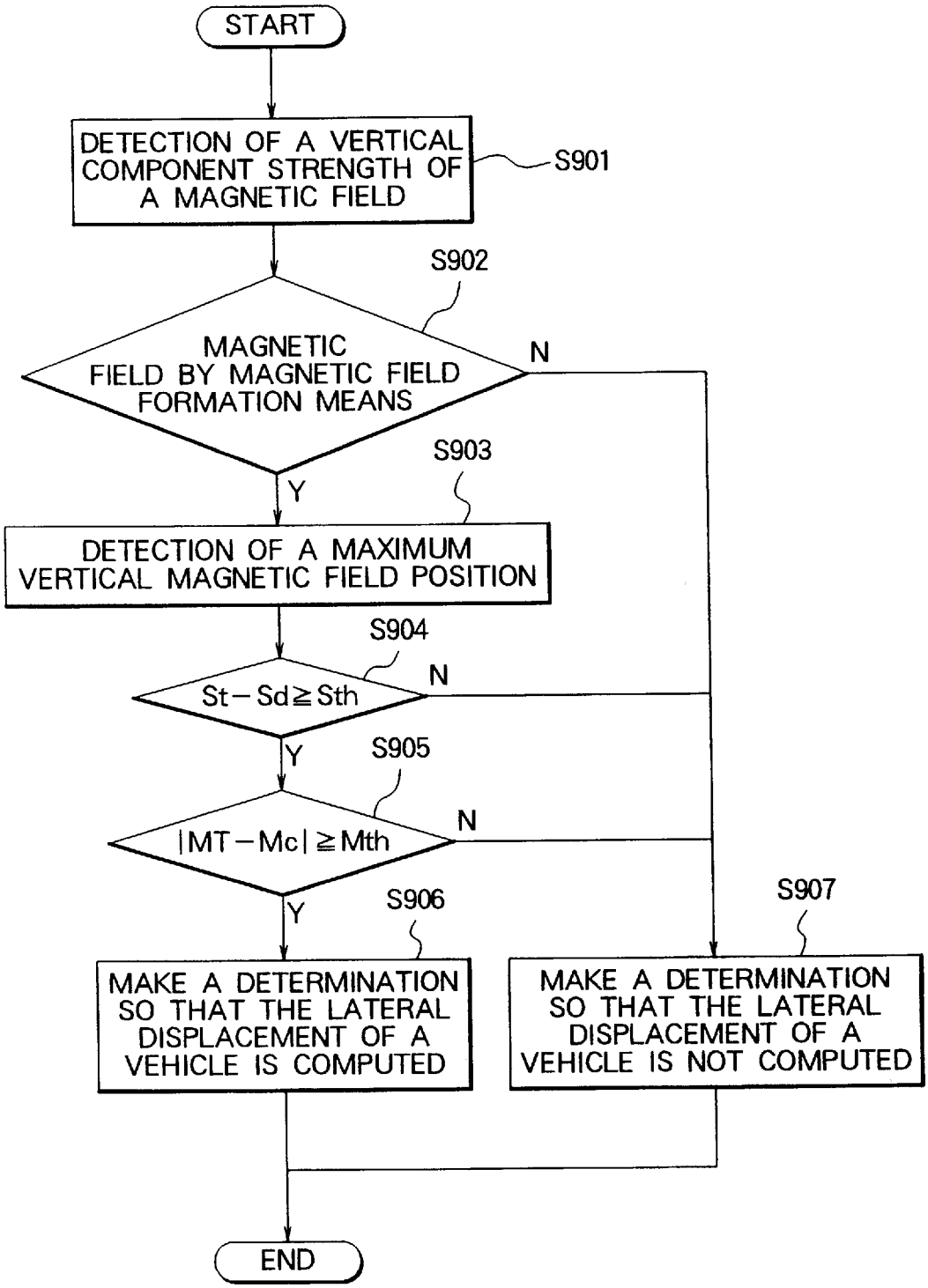
FIG. 9 is a flowchart showing the process that is performed by the vehicle position recognition apparatus of the fourth embodiment.

The operation of the fourth embodiment shown in FIG. 7 will be described according to a flowchart of FIG. 9. First, the vertical magnetic field strength detection means 7-1 detects the vertical component of a magnetic field strength (step S901). Then, it is judged whether or not the vertical component of a magnetic field strength, obtained in step S901, is the vertical component of the magnetic field strength formed by the magnetic field formation means 8-2 (step S902).

If it is judged that the vertical component of a magnetic field strength, obtained in step S901, is the vertical component of the magnetic field strength formed by the magnetic field formation means 8-2, then the maximum position of the vertical component of a magnetic field strength obtained will be detected by the maximum vertical magnetic field position detection means 7-3 (step S903). Next, the magnetic field strength change quantity detection means 7-4 judges whether the change quantity, between the maximum value $S_t$ of the maximum position of the vertical component of a magnetic field strength detected in step S903 and the value $S_d$ of the vertical component of a magnetic field strength at a position away from the maximum position by a predetermined distance, is greater than a threshold value (e.g., it is judged whether $S_t-S_d \geqq S_{th}$) (step S904).

Next, the maximum vertical magnetic field strength transition comparison means 7-5 judges whether the absolute value of the change quantity, between a value $M_o$ of the vertical component of a past magnetic field strength and a value $M_t$ of the vertical component of a magnetic field obtained in step S901, is less than a threshold value (e.g., it is judged whether $|M_t-M_o| \geqq M_{th}$) (step S905). Then, if all judgments in steps S902, S904, and S905 are "YES," the lateral displacement computation of a vehicle will be performed by the computation suitability judgment means 7-6 (step S906). When, on the other hand, any one of the judgments is "NO," the computation suitability judgment means 7-6 does not perform the lateral displacement computation of a vehicle (step S907).

Fifth Embodiment

Figure 10:
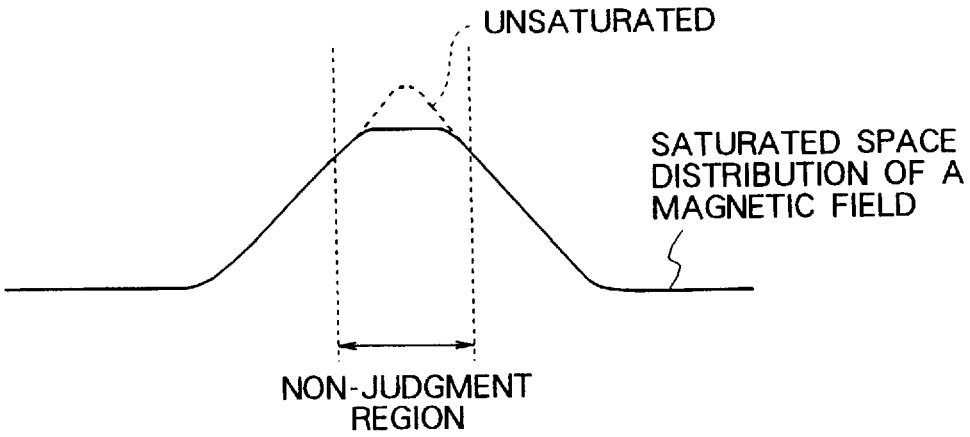
FIG. 10 is a diagram used to explain the concepts of the vehicle position recognition apparatus of a fifth embodiment of the present invention.

Even when a vehicle were influenced, for example, by rolling and a sampled magnetic field strength were in a form saturated with a magnetic field strength greater than the dynamic range of the magnetic field strength detection means, the saturated portion could be excluded from the suitability judgment of the lateral displacement computation by providing a non-judgment region having a predetermined distance, as shown in FIG. 10. Therefore, the vertical magnetic field strength comparison means can perform the suitability judgment of the lateral displacement computation, excluding the rolling influence of a vehicle.

Sixth Embodiment

Figure 11:
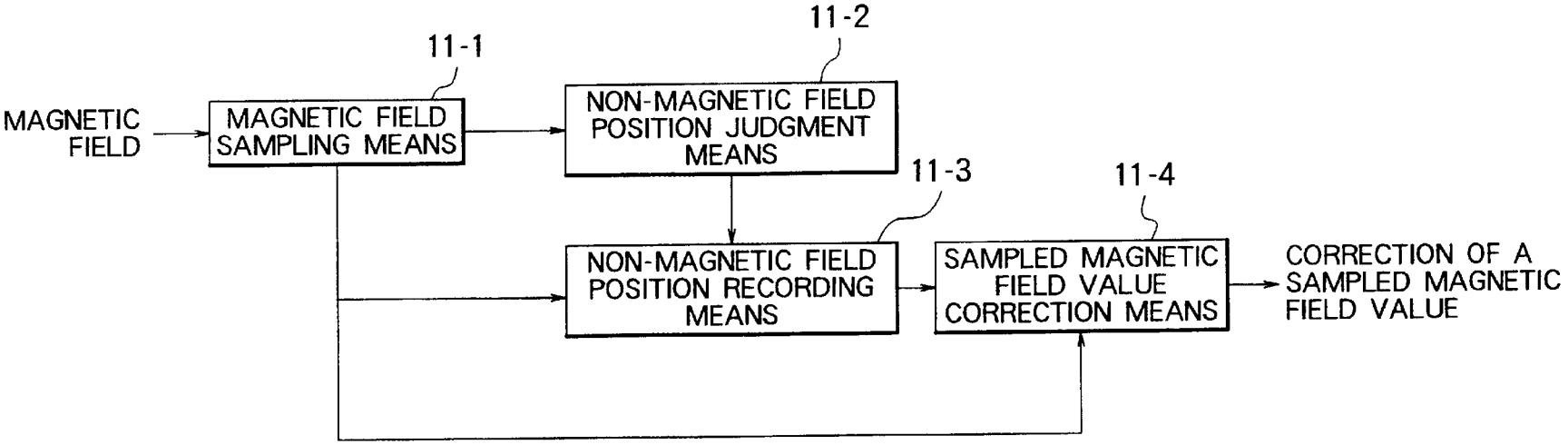
FIG. 11 is a block diagram showing a vehicle position recognition apparatus in accordance with a sixth embodiment of the present invention.

FIG. 11 is a block diagram showing magnetic field strength detection means 1-4 in accordance with a sixth embodiment of the present invention. It is the objective of the magnetic field strength detection means 1-4 of this embodiment to accurately obtain the magnetic field strength space distribution formed by the magnetic field formation means 1-2, while excluding the influence of a magnetic field caused by either terrestrial magnetism or magnetization to a vehicle.

The magnetic field strength detection means 1-4 is equipped with magnetic field sampling means 11-1 for sampling magnetic field state to obtain a magnetic field space distribution, non-magnetic field position judgment means 11-2 for judging whether a sampled current value is in a non-magnetic field region from the sampled magnetic field state, non-magnetic field position recording means 11-3 for recording a sampled magnetic field value if it is in a non-magnetic field region, and sampled-magnetic field value correction means 11-4 for correcting a sampled magnetic field value recorded while a vehicle travels from a non-magnetic field region, then passes through a magnetic field region formed by the magnetic field formation means 1-2, and then finally travels through the next non-magnetic field region.

Figure 12:
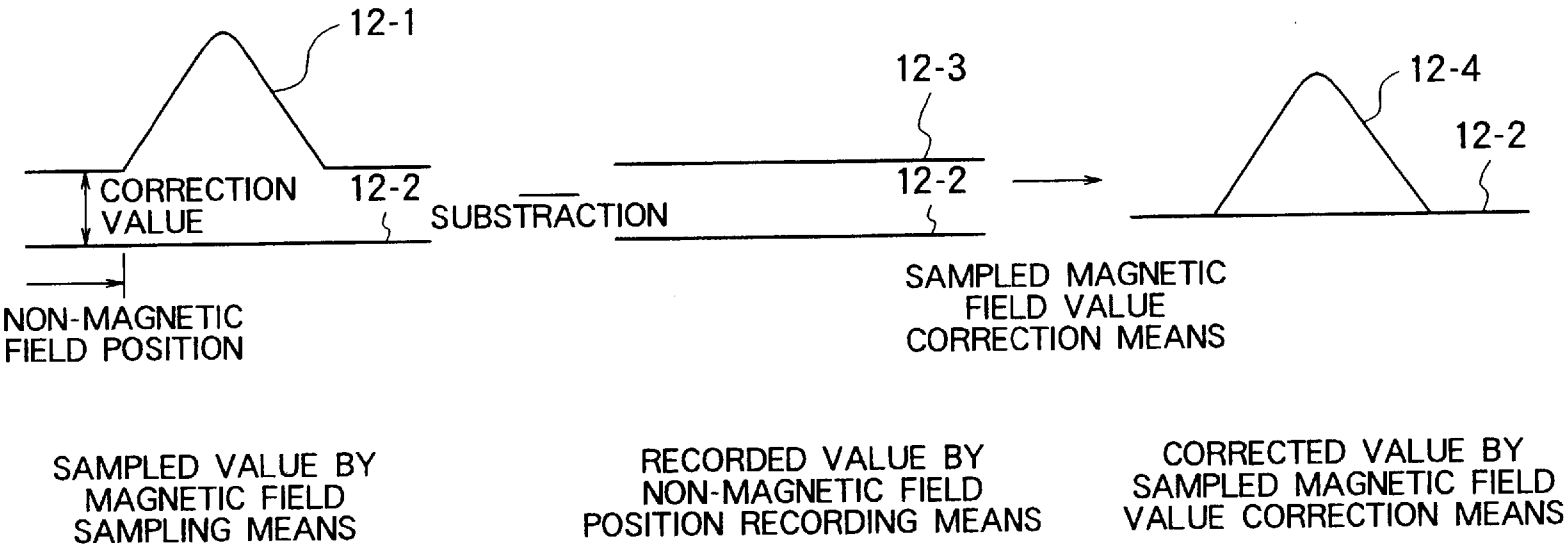
FIG. 12 is a diagram used to explain the concepts of the vehicle position recognition apparatus of the sixth embodiment.

FIG. 12 schematically shows how the recorded sampled magnetic field value is corrected and output. Until a vehicle travels from a non-magnetic field region, then passes through a magnetic field region formed by the magnetic field formation means 1-2, and then finally travels through the next non-magnetic field region, the non-magnetic field position recording means 11-3 is recording sampled magnetic field values by using a distribution such as that indicated by 12-1.

During the time a vehicle travels through a non-magnetic field region, the non-magnetic field position recording means 11-3 records either terrestrial magnetism or a quantity of magnetization to a vehicle, as magnetic field sampling. This sampled magnetic field value assumes a value having a constant level with respect to reference value 12-2, and this value becomes correction value 12-3.

If a vehicle goes into a magnetic field region formed by the magnetic field formation means 1-2, the sampled magnetic field value 12-1 will be varied according to a change in the magnetic field strength and the varied value will be increased as a whole by a correction value. That is, the magnetic field strength space distribution includes the influence of terrestrial magnetism or magnetization to a vehicle. For this reason, the sampled magnetic field strength is not obtainable as an accurate magnetic field strength formed by the magnetic field formation means 1-2.

The correction value 12-3 is a constant value, and therefore, by subtracting the correction value 12-3 from the recorded sampled magnetic field value 12-1 by the sampled-magnetic field value correction means 11-4 after a vehicle travels from a magnetic field region into a non-magnetic field region, there is obtainable the sampled magnetic field value 12-4 after correction, excluding the influence of terrestrial magnetism or magnetization to a vehicle, that is, a magnetic field strength space distribution formed by the magnetic field formation means.

Seventh Embodiment

Although the aforementioned embodiments have provided a single magnetic field strength detection means 1-4 in a vehicle and have detected a magnetic field by magnetic field formation means 1-2, there are cases where, depending on the traveling state of a vehicle, the magnetic field strength detection means 1-4 passes away from the magnetic field formation means 1-2, for example, by more than 30 cm in a horizontal direction. In such cases, the magnetic field strength detection means 1-4 cannot obtain the space distribution of a magnetic field strength that is suitable for a computation of lateral displacement.

In this embodiment, in order to overcome such a disadvantage, a plurality of magnetic field strength detection means 1-4 (e.g., three detection means) are arranged in a vehicle in a row at predetermined intervals, and regardless of the traveling state of the vehicle, the space distribution of a magnetic field strength that is suitable for a computation of lateral displacement is obtained from the magnetic field formation means 1-2 by at least one of the plurality of magnetic field strength detection means 1-4.

Figure 13:
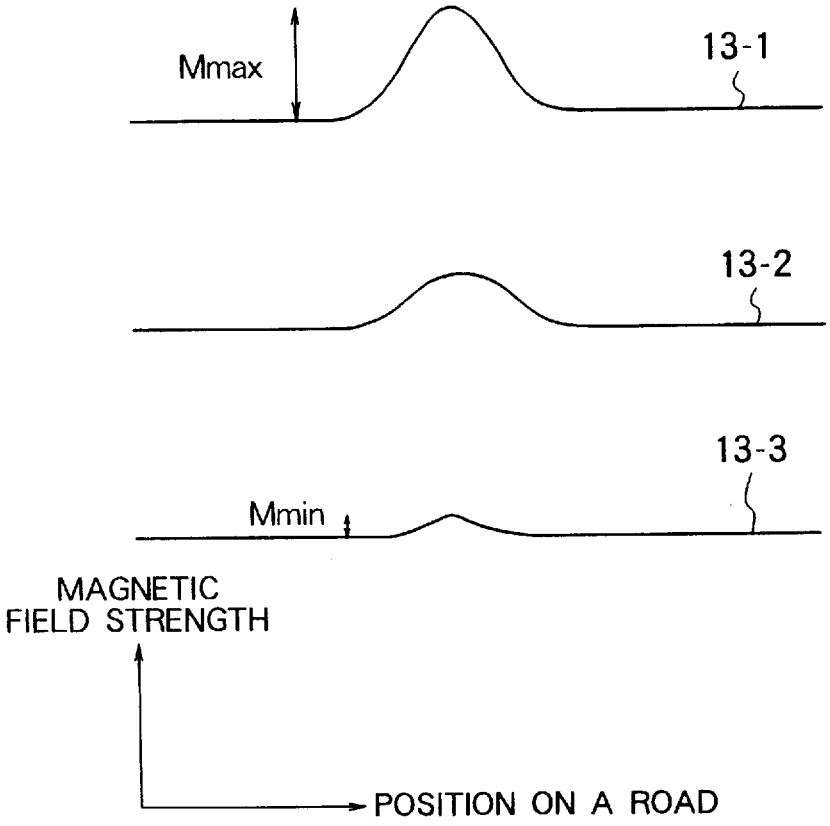
FIG. 13 is a diagram used to explain the concepts of the vehicle position recognition apparatus of a seventh embodiment of the present invention.
Figure 14:
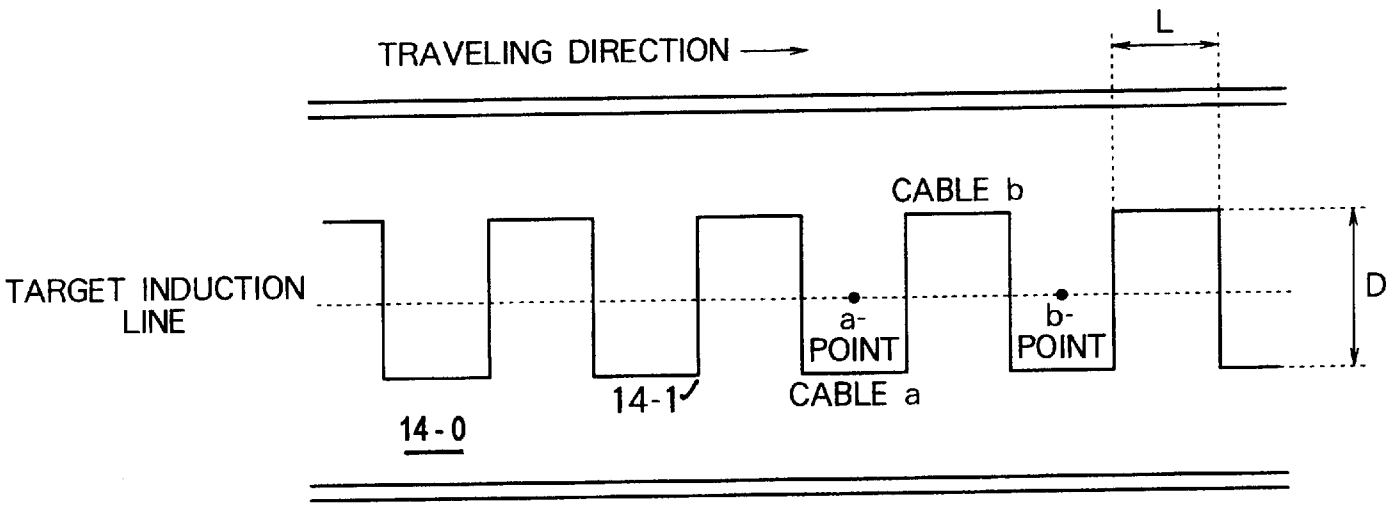
FIG. 14 PRIOR ART
FIG. 14 is a diagram showing the installed state of a magnetic field induction cable that is employed in a vehicle position detector.
Figure 15:
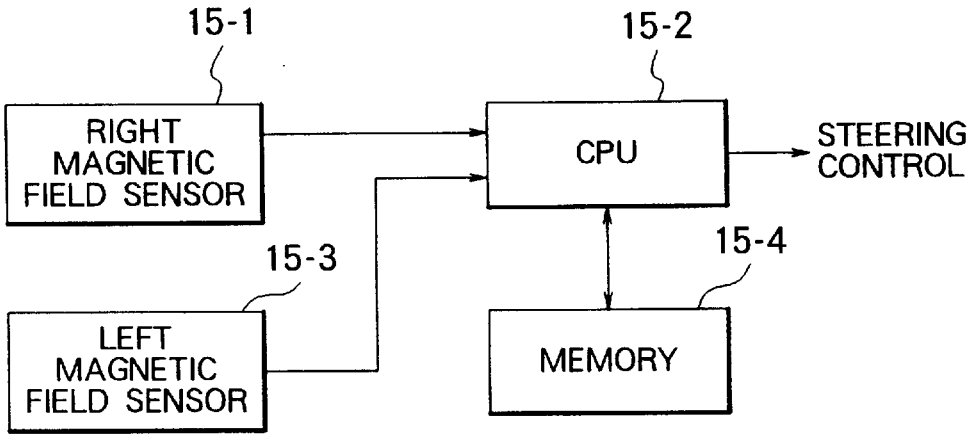
FIG. 15 PRIOR ART
FIG. 15 is a block diagram of a conventional vehicle position recognition apparatus.
Figure 16:
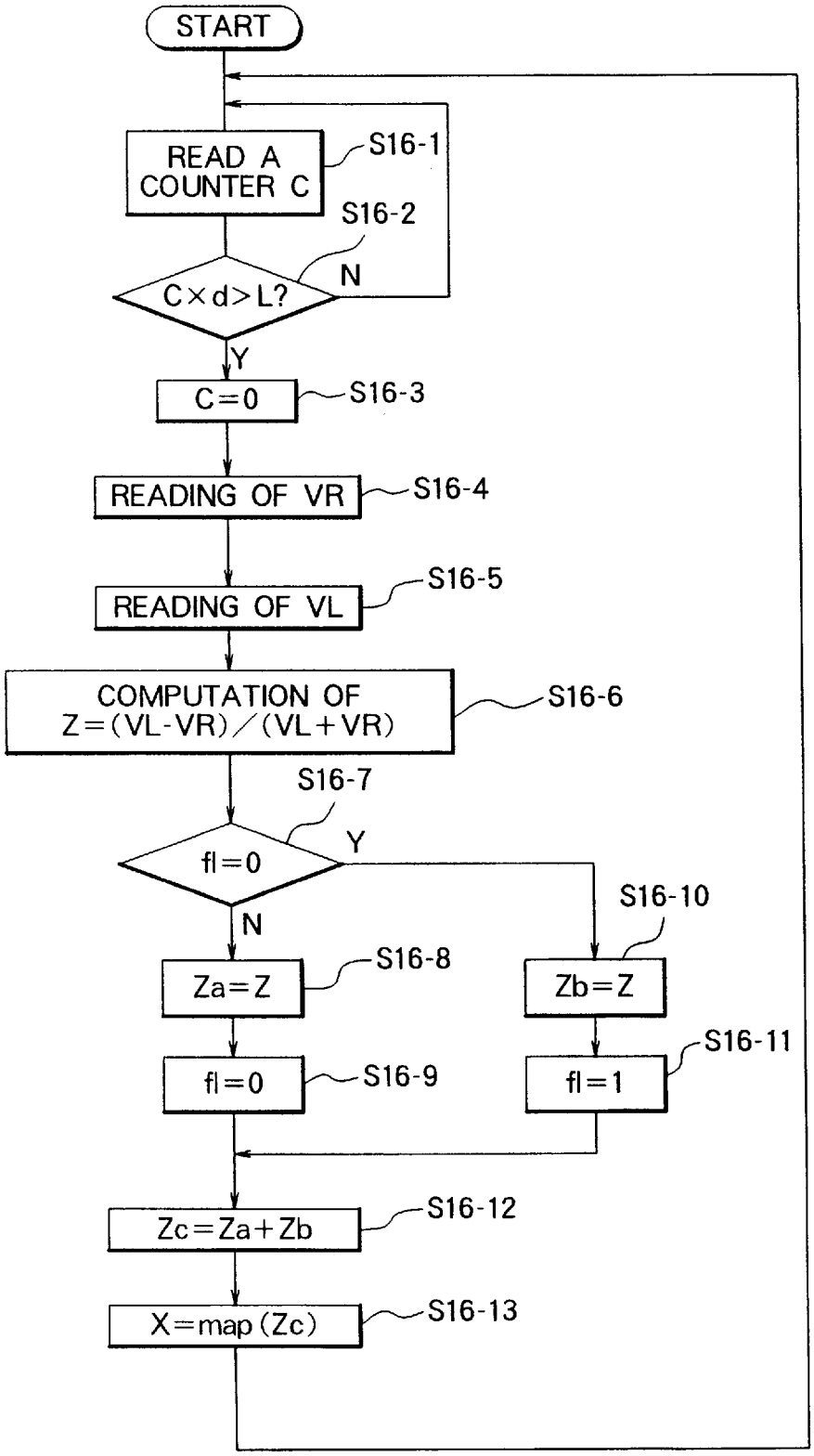
FIG. 16 PRIOR ART
FIG. 16 is a flowchart showing the process that is performed by the conventional vehicle position recognition apparatus.

However, if a plurality of magnetic field strength detection means 1-4 are arranged as previously described and if the plurality of magnetic field strength detection means 1-4 detect the magnetic field formation means 1-2, the magnetized joint portion of a bridge, and magnetized objects embedded in a road, then magnetic field strength space distributions 13-1, 13-2, and 13-3 will be obtained as shown in FIG. 13.

At this time, since the magnetic field strength space distribution 13-1 has a maximum magnetic field strength, the value at this time is made $M_{max}$. Also, the magnetic field strength space distribution 13-3 has a minimum magnetic field strength, so the magnetic field strength at this time is made $M_{min}$. Next, when $M_{max}-M_{min}$ is greater than or equal to $M_{thr}$, the vehicle position computation suitability judgment means 1-5 judges that a detected magnetic field strength is suitable for the lateral displacement computation of a vehicle. Then, the vehicle position computation means 1-6 computes the lateral displacement of the vehicle by employing the magnetic field strength space distribution 13-1. Note that the aforementioned $M_{thr}$ is a previously set threshold value.

When $M_{max}-M_{min} \geqq M_{thr}$ is not satisfied, each magnetic field strength detection means 1-4 judges that a magnetic substance other than the magnetic field formation means 1-2 has been detected, and does not perform the lateral displacement computation of a vehicle. That is, if each magnetic field strength detection means 1-4 detects joint portions of a bridge when a vehicle passes through the joint portions, there will be no possibility that a difference greater than the threshold value $M_{thr}$ will appear between magnetic field strengths. Therefore, even if the magnetic field strength space distribution of the magnetized joint portion were obtained, there would be no possibility of the lateral displacement computation of a vehicle.

While the invention has been described with reference to preferred embodiments thereof, the invention is not to be limited to the details given herein, but may be modified within the scope of the appended claims.

What is claimed is:

1. A vehicle position recognition apparatus for recognizing the position of a vehicle traveling on a road, comprising:

at least one magnetic field formation means provided at predetermined positions on the road for forming a magnetic field;

at least one magnetic field strength detection means for detecting the strength of the magnetic field formed by said magnetic field formation means;

vehicle position computation suitability judgment means for judging whether or not the magnetic field strength detected by said magnetic field strength detection means is suitable for position computation of the vehicle; and vehicle position computation means for detecting the position of the vehicle from the magnetic field strength detected by said magnetic field strength detection means, based on a result of the judgment performed by said vehicle position computation suitability judgment means, wherein said vehicle position computation suitability judgment means comprises:

vertical magnetic field strength detection means for detecting a vertical component of the magnetic field strength obtained by said magnetic field strength detection means;

vertical magnetic field strength comparison means for comparing a space distribution of the vertical magnetic field strength obtained by said vertical magnetic field strength detection means with a space distribution of the vertical component of the magnetic field strength formed by said magnetic field formation means;

maximum vertical magnetic field position detection means for detecting a position of the maximum vertical magnetic field on the space distribution of the vertical magnetic field strength detected by said vertical magnetic field strength detection means;

magnetic field strength change quantity detection means for comparing a vertical magnetic field strength at the maximum vertical magnetic field position detected by said maximum vertical magnetic field position detection means with a magnetic field strength at a position away from the maximum vertical magnetic field position by a predetermined distance and for detecting a change quantity in the magnetic field caused by the distance;

maximum vertical magnetic field strength transition comparison means for comparing the magnetic field strength at the maximum vertical magnetic field position detected by said maximum vertical magnetic field position detection means with a past maximum vertical magnetic field strength detected by said maximum vertical magnetic field position detection means; and computation suitability judgment means for judging whether or not the detected magnetic field strength is suitable for the position computation of the vehicle, based on results of said magnetic field strength change quantity detection means and said maximum vertical magnetic field strength transition comparison means.

2. The vehicle position recognition apparatus as set forth in claim 1, wherein said magnetic field strength detection means comprises:

traveled-distance computation means for computing a distance traveled by the vehicle;

magnetic field sampling means for sampling magnetic field state at intervals of predetermined distance; and magnetic field recording means for recording a space distribution of the magnetic field strength obtained by said magnetic field sampling means.

3. The vehicle position recognition apparatus as set forth in claim 1, wherein said vertical magnetic field strength comparison means does not compare the maximum vertical magnetic field strength in a non-judgment region which has a predetermined width from the center of the maximum vertical magnetic field position obtained by said maximum vertical magnetic field position detection means.

4. The vehicle position recognition apparatus as set forth in claim 1, wherein said magnetic field strength detection means comprises:

non-magnetic field position judgment means for judging a position which is not influenced by the magnetic field formed by said magnetic field formation means;

non-magnetic field position recording means for recording a magnetic field strength value sampled at the non-magnetic field position; and sampled-magnetic field value correction means for correcting a magnetic field value sampled at a magnetic field position by a sampled magnetic field strength value recorded by said non-magnetic field position recording means.

5. The vehicle position recognition apparatus as set forth in claim 1, wherein said vehicle position computation suitability judgment means judges whether or not an absolute value of a difference between the maximum and minimum strengths of magnetic field strengths, obtained by a plurality of magnetic field strength detection means, is greater than a predetermined threshold value.

* * * * *